US007975321B1

(12) United States Patent
Behrens

(10) Patent No.: US 7,975,321 B1
(45) Date of Patent: Jul. 12, 2011

(54) COMBINATION NECK BRACE INCORPORATED INTO A BODY PROTECTOR

(75) Inventor: Steven J. Behrens, Costa Mesa, CA (US)

(73) Assignee: Valencia Sport Group, Inc., Valencia, CA (US)

( * ) Notice: Subject to any disclaimer, the term of this patent is extended or adjusted under 35 U.S.C. 154(b) by 758 days.

(21) Appl. No.: 11/998,047

(22) Filed: Nov. 28, 2007

(51) Int. Cl.
*A41D 13/00* (2006.01)

(52) U.S. Cl. ..... 2/468

(58) Field of Classification Search ..... 2/468, 455, 2/2.15, 44, 45, 102, 92, 94, 467; 128/95.1, 128/97.1; 602/5, 18
See application file for complete search history.

(56) References Cited

U.S. PATENT DOCUMENTS

| | | | | |
|---|---|---|---|---|
| 3,514,784 | A | 6/1970 | McDavid | |
| 4,449,251 | A | 5/1984 | Gauthier | |
| 4,501,023 | A | 2/1985 | Bilberry | |
| 4,590,622 | A | 5/1986 | Wolfe et al. | |
| 4,821,339 | A | 4/1989 | Fair | |
| 4,996,720 | A | 3/1991 | Fair | |
| 5,404,590 | A | 4/1995 | Monica, Jr. | |
| 5,411,471 | A | 5/1995 | Terrazas | |
| 5,546,601 | A | 8/1996 | Abeyta | |
| 5,946,719 | A | 9/1999 | Crupi et al. | |
| 6,067,665 | A | 5/2000 | DePalma et al. | |
| 6,195,802 | B1 | 3/2001 | Aremllino | |
| 6,874,170 | B1 | 4/2005 | Aaron | |
| 7,103,924 | B2 * | 9/2006 | Morrow et al. | 2/461 |
| 7,306,573 | B2 * | 12/2007 | Bonutti | 602/18 |
| 7,371,221 | B1 * | 5/2008 | Baker | 602/18 |

* cited by examiner

*Primary Examiner* — Tejash Patel
(74) *Attorney, Agent, or Firm* — Luce, Forward, Hamilton & Scripps LLP

(57) ABSTRACT

A combination neck brace incorporated into a body protector which is formed as an entire integrated unit to be worn to protect the neck and the body of a user, including the concept of a foam rubber protector which surrounds the neck region of the body and is incorporated into and made a part of a plastic or fiberglass protective shield which has a body portion that extends around the entire torso of the body so that the neck protector portion is incorporated into the torso protector portion to perform a full integrated unit. The neck protector portion has a rotatable hinge member than enables a neck protector portion to be moved forwardly so that the head can be inserted through the neck protector section and thereafter return to its original position to tightly envelope the neck and provide the protective shield to the neck and head area.

19 Claims, 8 Drawing Sheets

COMBINATION NECK BRACE INCORPORATED INTO A BODY PROTECTOR

BACKGROUND OF THE INVENTION

1. Field of the Invention

The present invention relates to the field of devices that are used to protect the rider while the rider is engaged in an activity such a riding a motorcycle. The devices are specifically designed to protect the head and the body so that in the event of an accident, the most critical portions of a rider's anatomy which include the head and neck and body portion will be protected to the maximum extent possible to reduce any injury to the rider.

2. Description of the Prior Art

In general, the concept of a protective device to protect the head and neck of a rider is known. The following 13 patents are relevant to the field of the present invention.

1. U.S. Pat. No. 3,514,784 issued to Robert F. McDavid on Jun. 2, 1970 for "Protective Football Apparatus" (hereafter the "McDavid Patent");

2. U.S. Pat. No. 4,449,251 issued to Jean-Marc Gauthier on May 22, 1984 for "Neck And Collarbone Protector" (hereafter the "Gauthier Patent");

3. U.S. Pat. No. 4,501,023 issued to Johnny B. Bilberry on Feb. 26, 1995 for "Neck Support" (hereafter the "Bilberry Patent");

4. U.S. Pat. No. 4,590,622 issued to Robert A. Wolfe et al. and assigned to All American Inc. on May 27, 1986 for "Shoulder, Chest And Neck Protective Device" (hereafter the "Wolfe Patent");

5. U.S. Pat. No. 4,821,339 issued to Jeffrey D. Fair on Apr. 18, 1989 for "Protective Vest Having A Cervical Collar" (hereafter the "'339 Fair Patent");

6. U.S. Pat. No. 4,996,720 issued to Jeffrey D. Fair on Mar. 5, 1991 for "Protective Vest Having A Cervical Collar" (hereafter the "'720 Fair Patent");

7. U.S. Pat. No. 5,404,590 issued to Theodore A. Monica, Jr. and assigned to Riddell, Inc. on Apr. 11, 1995 for "Football Helmet Motion Restrictor" (hereafter the "Monica Patent");

8. U.S. Pat. No. 5,411,471 issued to Luis Terrazas on May 2, 1995 for "Neck Relaxer" (hereafter the "Terrazas Patent");

9. U.S. Pat. No. 5,546,601 issued to Alan Abeyta on Aug. 20, 1996 for "Neck And Cervical Spine Protector Device For Dispersing Axial Compressive Forces" (hereafter the "Abeyta Patent");

10. U.S. Pat. No. 5,946,719 issued to Vincent G. Crupi et al. and assigned to Med-Eng Systems, Inc. on Sep. 7, 1999 for "Neck And Head Protection System" (hereafter the "Crupi Patent");

11. U.S. Pat. No. 6,067,665 issued to Bernard F. DePalma et al. and assigned to Cramer Products, Inc. on May 30, 2000 for "Adjustable Protective Collar" (hereafter the "DePalma Patent");

12. U.S. Pat. No. 6,195,802 issued to Stephen E. Armellino and assigned to U.S. Armor Corporation on Mar. 6, 2001 for "Tactical Vest" (hereafter the "Armellino Patent");

13. U.S. Pat. No. 6,874,170 issued to Todd D. Aaron on Apr. 5, 2005 for "Head And Neck Protection System" (hereafter the "Aaron Patent").

The McDavid Patent discloses the concept of incorporating a neck support member attached to the shoulder harness of an object which is to be worn by football players during activities. Specifically, the device includes a pair of elongated rectangular back panels which are hingeably attached which enable the device to be rotated open for placement onto a player. This also extends to a breast connector plate as illustrated. The panels extend across a player's cervical spine and also behind the player's neck as shown in the drawings. Therefore, this invention discloses the broad general concept of incorporating a neck protector into a shoulder harness.

The Gauthier Patent discloses a neck and collar bone protector which is a neck protector with a portion that can be worn over the collar bone area. There is a collar 12 connected to a bib 10 through a neck edge 14 of the bib. The collar can be wrapped around the person's neck and retained therein by hook and loop fasteners. The collar extends to a bib which rests on the top portion of a person's chest.

The Bilberry Patent is a neck support. It includes a neck support 2 which is a flexible shape collar. A front support 7 is attached to segments of the collar and lies adjacent ends 5 of the collar. The collar 2 is described as being made of relatively soft and resilient sponge rubber. The collar is shown as having lace supports 15 which extend through respective openings in a breast plate which is comparable to a shoulder pad. Therefore, what this discloses is a spongy neck support collar tied to a breast plate.

The Wolfe Patent is a combination shoulder, chest and neck protecting device which in effect is a vest with various attachments as shown to protect different upper body parts. This includes a neck roll 90 which is attached as part of the vest assembly.

The '339 Fair Patent discloses a protective vest having a cervical collar where essentially the cervical collar member is formed into and is made a part of the protective vest so that it can be worn underneath a football helmet. However, there is an open front and it does not entirely surround the neck and is simply designed to protect the back of the neck as an additional protection means against whiplash and additional rearward movement of the neck.

The '720 Fair Patent discloses a cervical collar again incorporated into a vest. Once again, the collar is protecting the rear portion of the neck but in this case there is the addition of additional panels such as 106 which surround the front portion of the neck. Therefore, the neck is entirely enclosed by the collar panels 12 and 106 incorporated into a chest protector.

The Monica Patent includes a football helmet motion restrictor provided on a football chest protector which is best illustrated in FIG. 3 provides a restriction means for the helmet. This goes only partially around the neck and is more intended to go around the helmet to restrict its movement during athletic events.

The Terrazas Patent was defined as a neck relaxer and is more of a cervical collar which basically has a support section that extends over the back so that it prevents forward and backward movement of the neck while at the same time permitting rotational movement of the neck. The first claim which is the only independent claim in the patent states:

"An apparatus for supporting head, neck and back area of a human patient comprising:

a) an upper support element for supporting the head of the human patient;

b) a lower support element for supporting the back of the human patient; and c) a means for attaching said upper support element to said lower support element which allows said upper support mechanism to rotate in both lateral directions relative to the head of said human patient about an axis of rotation which is situated in alignment and juxtaposed with the posterior region of the head of the human patient when said apparatus is worn by the human patient while restraining the upper support element in the posterior and anterior directions relative to the head of said human patient."

This patent essentially discloses a neck protector with a section going down the back to prevent forward and backward movement of the neck.

The Abeyta Patent discloses a neck and cervical spine protector which is connected to the shoulder and chest protector device of a football protection system. The invention has the purpose of dispersing axial compressive forces on the head away from the neck and cervical spine region to the posterior midline portions of the shoulder and upper thorax regions of the user's body. This also discloses a generally u-shaped structure 34 on the back of the neck attached to the back of the shoulder pads. The invention claims the concept of the u-shaped structure for fitting about the back and opposite sides of the neck of a user a resting on the posterior midline portion of the shoulders and means to find the u-shape structure for seating thereon a head protector worn by the user and then a lower structure which relies over the chest portion of the wearer.

The Crupi Patent essentially is a protective system which includes the helmet and a protective neck area with the purpose being to provide additional protection from the blast effects of exploding munitions.

The DePalma Patent is an adjustable protective collar which includes a protective pad 10 which is worn behind the user and is incorporated into the thorax chest protector portion. The collar only extends to the back of the neck and not around the entire neck and is for preventing backward movement of the neck during a football play in FIG. 8 with the helmet in a position right behind the back protective collar.

The Armellino Patent is what is called a tactical vest and essentially has a protective back collar with the innovative feature being that the collar can be raised to support the back of the neck and then lowered and attached to the back of the vest hook and loop fasteners when it is not necessary to have the collar around the back of the neck. It is intended as part of a chest protector for a bulletproof vest.

The Aaron Patent discloses a head and neck protection system which includes the protective collar which can be attached by snap members to a football helmet and also attached by stack members to a chest protecting area.

There is a significant need for an improved device that substantially provides additional protection to a rider which provides much more effective protection to the head and neck area than the inventions set forth in the prior art embodiments.

SUMMARY OF THE INVENTION

The present invention is a combination neck brace incorporated into a body protector which is formed as an entire integrated unit to be worn to protect the neck and the body of a user. The present invention includes the concept of a foam rubber protector which surrounds the neck region of the body and is incorporated into and made a part of a plastic or fiberglass protective shield which has a body portion that extends around the entire torso of the body so that the neck protector portion is incorporated into the torso protector portion to perform a full integrated unit. The neck protector portion has a rotatable hinge member than enables a neck protector portion to be moved forwardly so that the head can be inserted through the neck protector section and thereafter return to its original position to tightly envelope the neck and provide the protective shield to the neck and head area.

It has been discovered, according to the present invention, that if a neck protector is incorporated into an entire body protector assembly, then the neck protector will serve as much more effective functional features to protect the neck and body during an accident including preventing hyperextension of the neck in either the forward or rearward direction to reduce the likelihood that the neck would be broken during an accident.

It has further been discovered, according to the present invention, that if the chest and neck protector are formed into an entire integrated unit with a simple rotational means to enable a portion of the neck protector to be dislodged and rotated away from the balance of the neck protector section, then the entire assembly can be easily lifted over a person with the head inserted through the neck protector area and thereafter, the front portion of the neck protector assembly rotated back into place and locked in place so that the entire unit carefully envelopes the neck and body portion of the rider to provide maximum protection to the user during a sporting event such as riding a motorcycle.

It is a further object of the present invention to provide a body protector having numerous ventilation holes in order to provide maximum comfort to the user.

It is therefore an object of the present invention to provide a combination neck and body protector which enables the neck protector portion to be incorporated into the body portions so that it provides a far more effective neck protection assembly to prevent hyperextension of the neck in either the forward or rearward direction.

It is another object of the present invention to provide a lightweight easy to attach neck and chest protector assembly wherein a minimum amount of effort is required to open the assembly so that it can be placed upon the user and thereafter quickly close the assembly so that it is quickly locked into an operational condition.

It is a further object of the present invention to provide a combination neck and body protector which will provide maximum protection to the neck to prevent hyperextension of the neck in the forward and backward direction and further provide ventilation holes in the body protector to provide maximum comfort to the user.

It is the general object of the present invention to provide a combination neck brace incorporated into a body protector to form an entire integrated unit to be worn to protect the neck and body during an accident including preventing hyperextension of the neck in either the forward or rear directions to reduce the likelihood that the neck would be broken during an accident.

Further novel features and other objects of the present invention will become apparent from the following detailed description and discussion, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Figure 1:
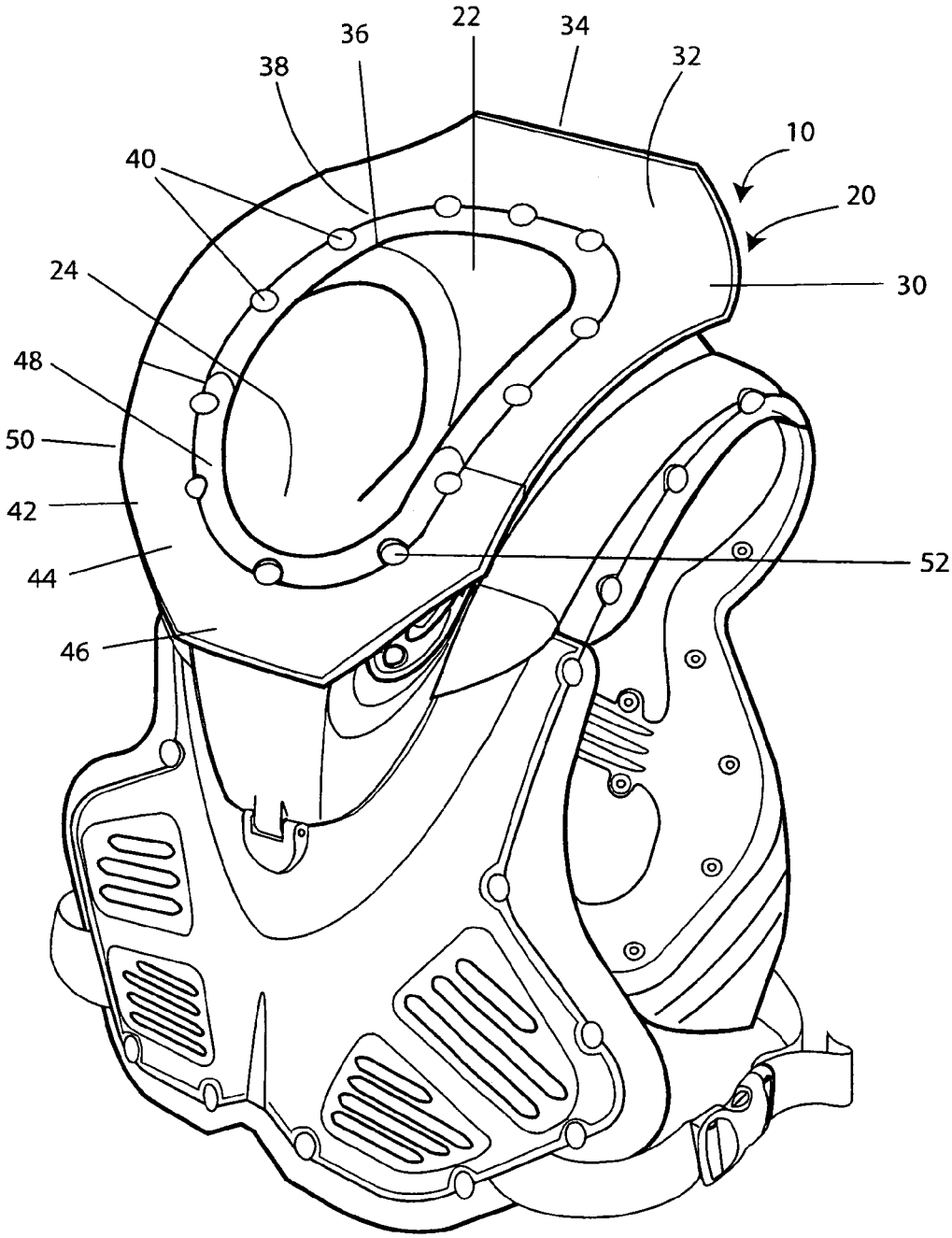
FIG. 1 is a perspective view of the present invention combination neck brace incorporated into a body protector in the closed position.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIGS. 1 through 8, the combination neck brace incorporated into a body protector 10 is illustrated from all views. Referring to FIGS. 1 and 3 through 8, the neck brace portion 20 has a rear section 30 which includes and arcuate planar section 32 which curves upwardly on its rearmost portion 34. Optionally, the rear section 30 has an interior foam cushioning 36 running along its interior edge 38, the cushioning 36 being removably affixed thereto by attachment means 40 such as a multiplicity of fastening bolts 40. Alternatively, the fastening means 40 can be rivets or other means by which the cushioning 36 is permanently attached to the interior edge 38 of the rear section 30. The rear section 30 partially encloses an interior opening 22.

The neck brace portion 20 also comprises a front section 42 which is movable relative to the rear section 30. In the closed position as illustrated in FIGS. 1 and 3 through 8, the front section 42 includes and arcuate planar section 44 which extends downwardly to its forward most portion 46. Optionally, the front section 42 has an interior foam cushioning 48 running along its interior edge 50, the cushioning 48 being removably affixed thereto by attachment means 52 such as a multiplicity of fastening bolts 52. Alternatively, the fastening means 52 can be rivets or other means by which the cushioning 48 is permanently attached to the interior edge 50 of the front section 42. The front section 42 partially surrounds an opening 24. The front section 42 is aligned with the rear section 30 to form a closed neck brace which surrounds a neck area of a wearer, the neck extending through interfitting openings 22 and 24.

The rear section 30 of the neck brace portion 20 extends to a lateral neck brace body member 60 which in turn is permanently affixed to the upper portion 72 of a body protector member 70. The body protector 70 comprises a front section 74 and a rear section 80 which are interconnected by a first arcuate connector section 76 and a second arcuate connector section 78. The front section 74 is made of a solid piece of material such as plastic, polyurethane, fiberglass, or other strong protective material. Similarly, the rear section 80 is also made of a solid piece of material such as plastic, polyurethane, fiberglass or other strong protective material. Similarly, the first arcuate connector section 76 and the second arcuate connector section 78 are each made of a solid piece of material such as plastic, polyurethane, fiberglass or other strong protective material. Preferably, the front section 74, rear section 80, and first and second arcuate connector sections 76 and 78 are molded out of a single piece of material with the lateral neck brace body member 60 also integrally molded to the first and section arcuate connector sections 76 and 78 and also integrally molded to the upper portion 82 of the rear section 80 of the body protector 70.

The body portion 70 further comprises a first lower interconnecting member 90 along one lower side which can be a strap or belt 92 having two sections with one section 93 attached at one end to the lower portion of the front section 74 and the second section 95 attached at one end to the lower portion of the rear section 80, the two sections 93 and 95 having respective interior mating interconnecting means 96 such as a female buckle 97 and male buckle 98. The body portion 70 further comprises a second lower interconnecting member 100 along the opposite lower side which can be a strap or belt 102 having two sections with one section 103 attached at one end to the lower portion of the front section 74 and the second section 105 attached at one end to the lower portion of the rear section 80, the two sections 103 and 105 having respective interior mating interconnecting means 106 such as a female buckle 107 and male buckle 108.

Figure 2:
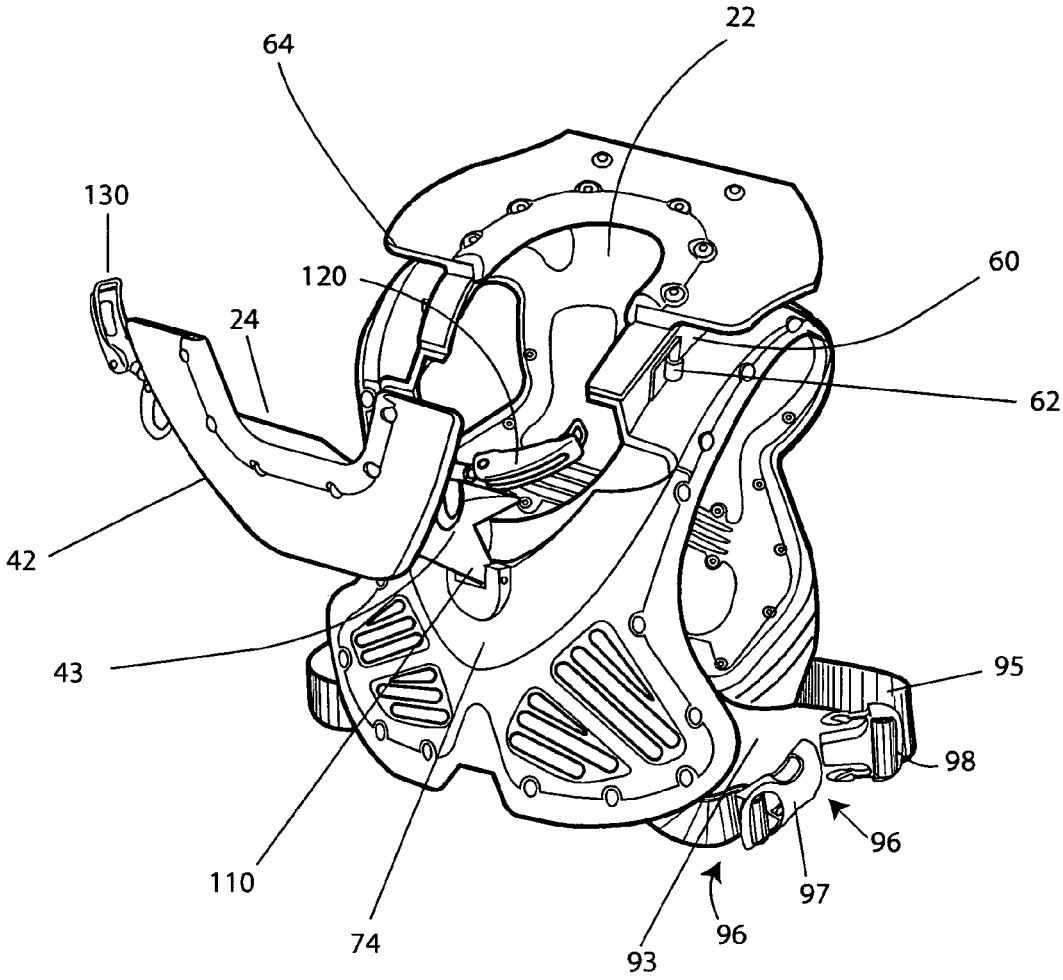
FIG. 2 is a perspective view of the present invention combination neck brace incorporated into a body protector with the neck brace rotated into the open condition so that the combination neck brace and body protector can be placed onto a user.
Figure 3:
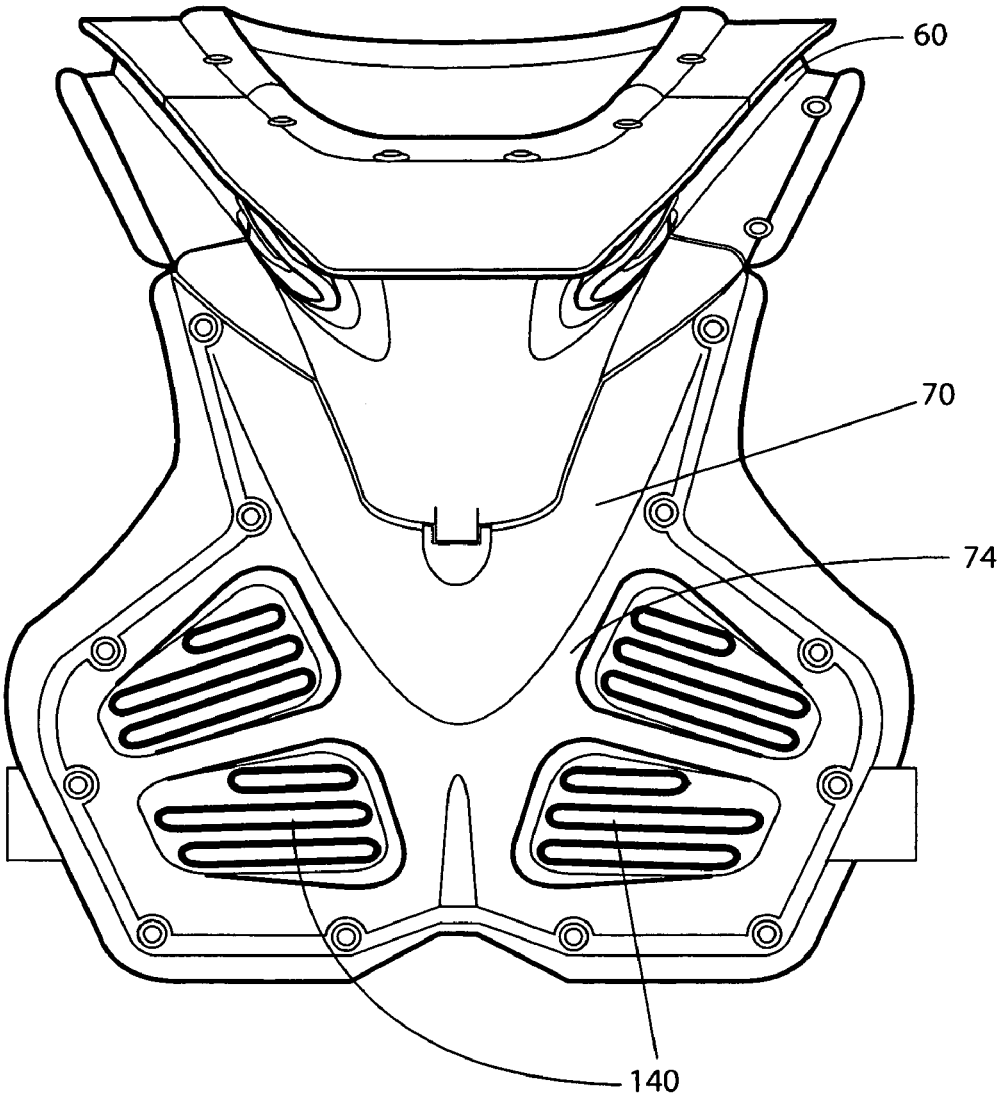
FIG. 3 is a front elevational view of the present invention combination neck brace incorporated into a body protector.
Figure 4:
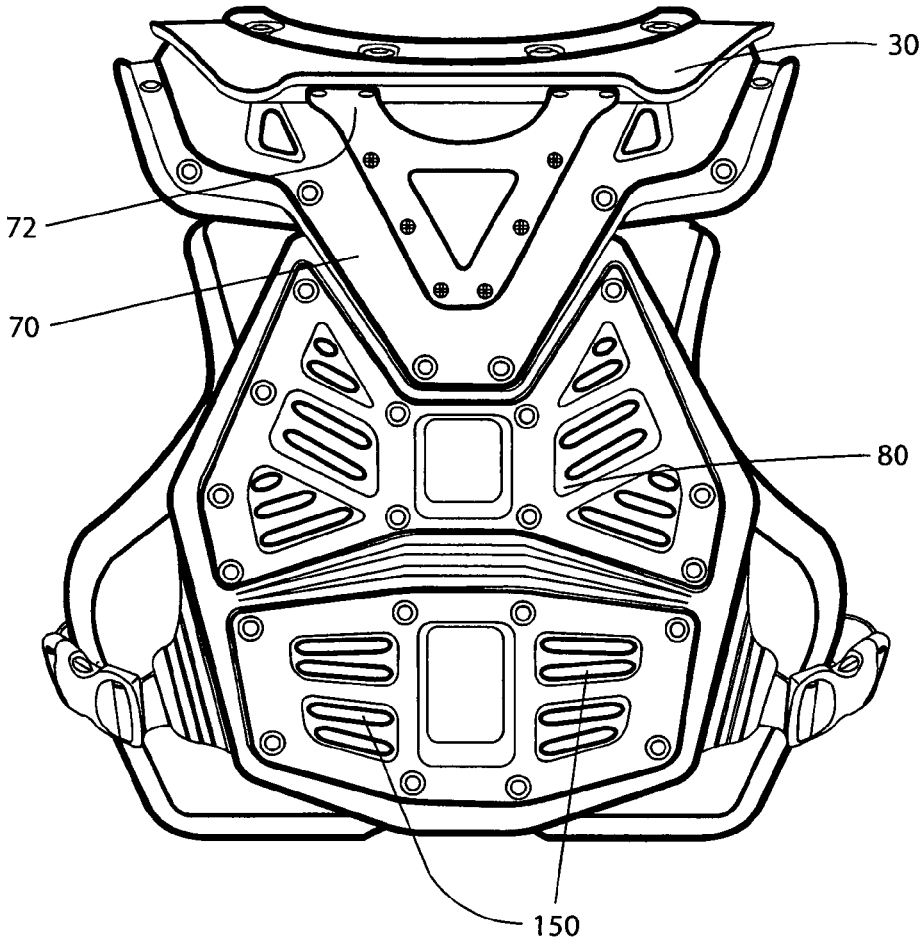
FIG. 4 is a rear elevational view of present invention combination neck brace incorporated into a body protector.
Figure 5:
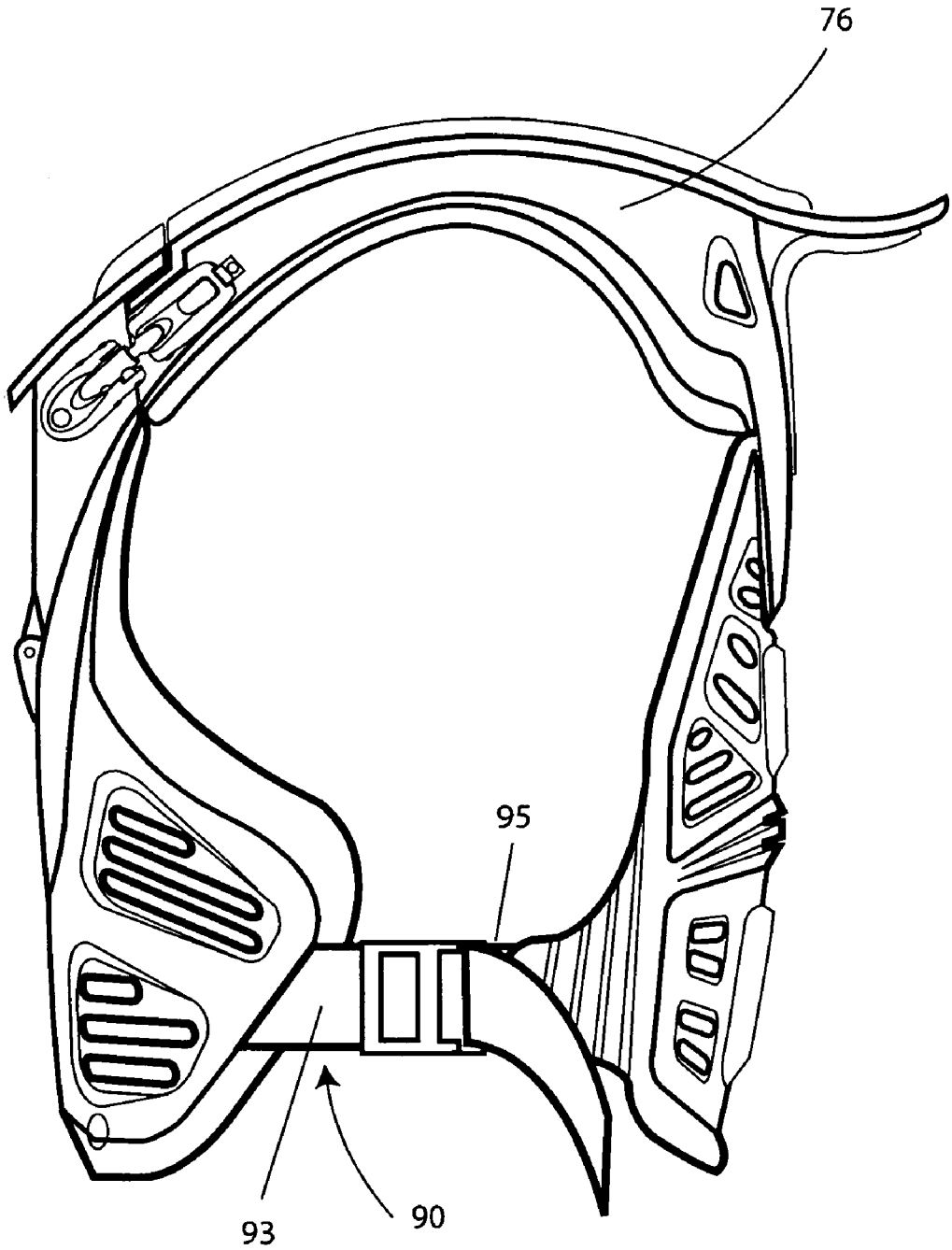
FIG. 5 is a side elevational view when viewed from the right side of present invention combination neck brace incorporated into a body protector.
Figure 6:
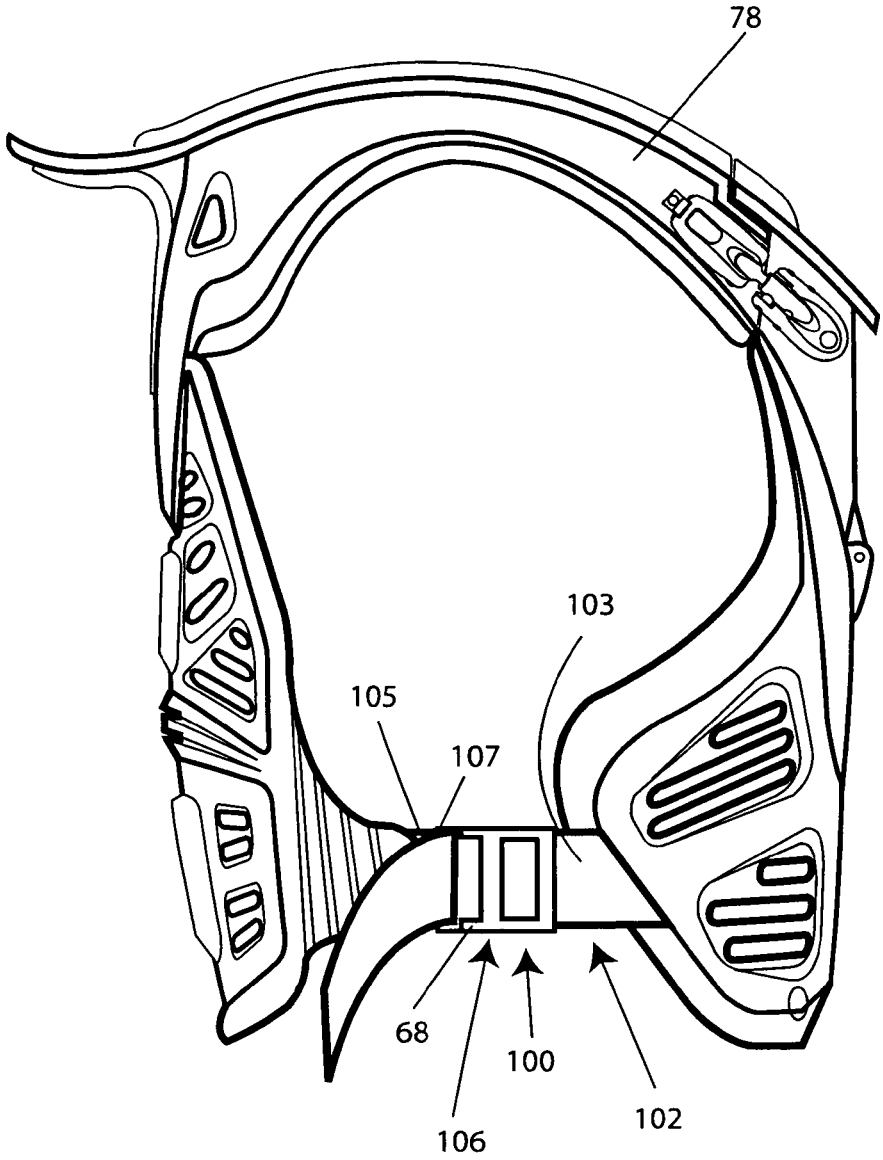
FIG. 6 is a side elevational view when viewed from the left side of present invention combination neck brace incorporated into a body protector.
Figure 7:
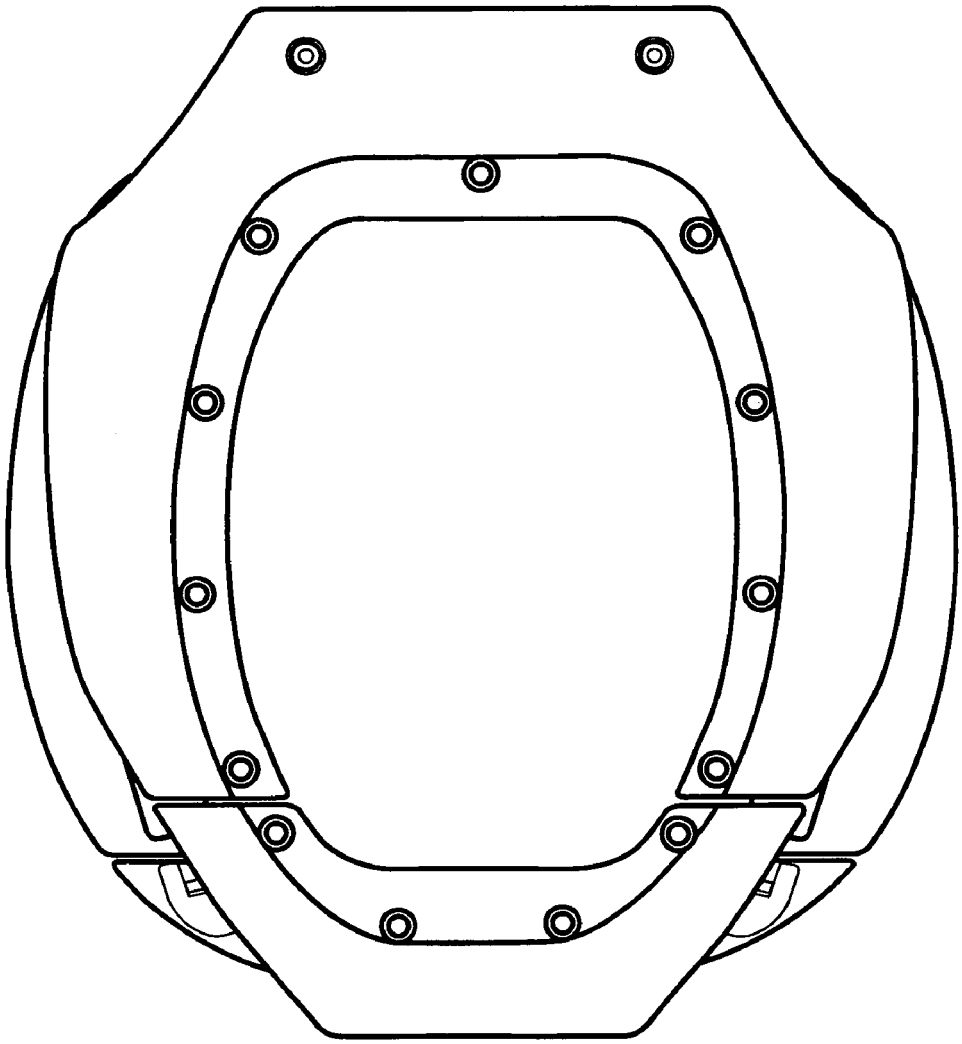
FIG. 7 is a top plan view of the present invention combination neck brace incorporated into a body protector.
Figure 8:
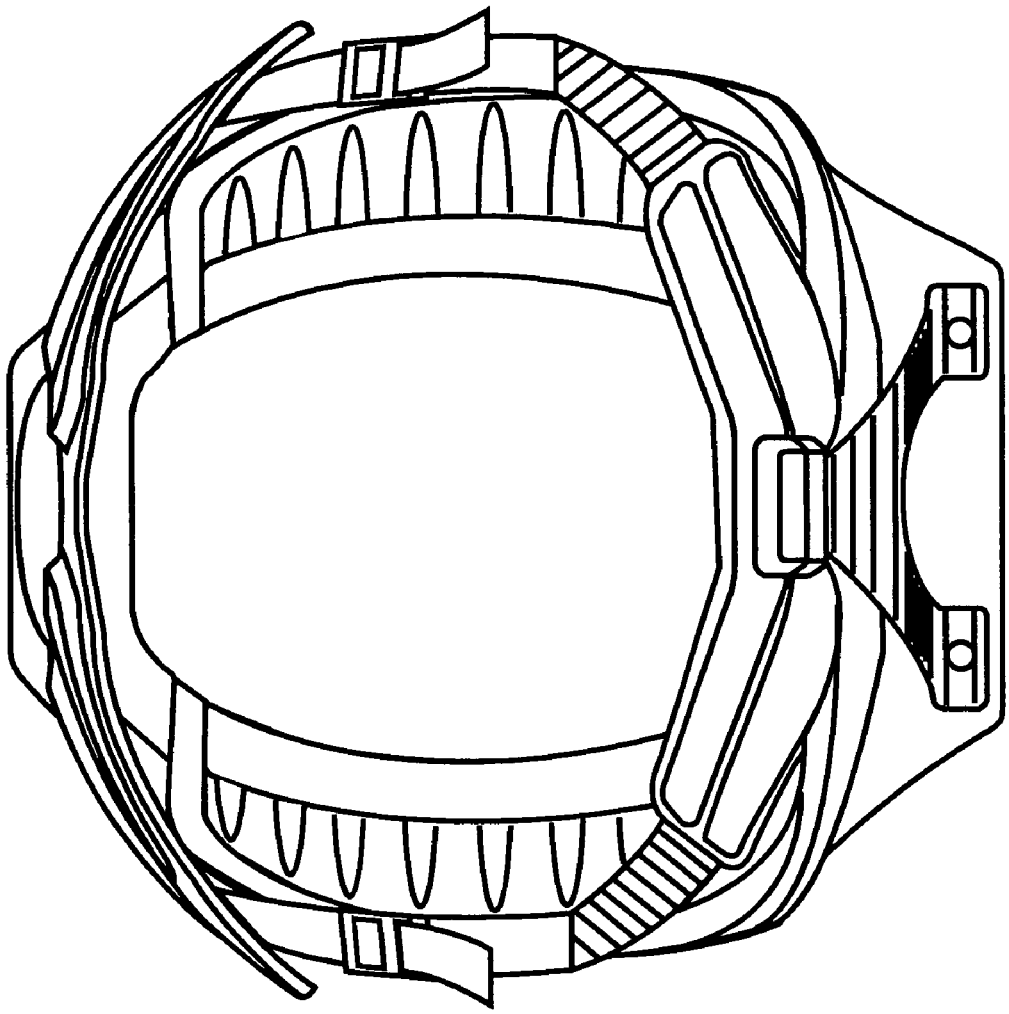
FIG. 8 is a bottom plan view of the present invention combination neck brace incorporated into a body protector.

The front section 42 of the neck brace portion 20 extends to a front section body portion 43 which in turn is movably affixed to the front section 74 of the body protector 70. By way of example, the movable attachment means 110 by which body portion 43 of the front section 42 of the neck brace portion 20 is attached to the front section 74 of the body protector 70 can be a rotatable hinge which interconnects the two members. The body potion 43 further comprises a pair of oppositely disposed interconnecting members 120 and 130. The body portion 60 of the rear section 30 of the neck brace portion 20 has a pair of oppositely disposed interconnection receiving members 62 and 64 which receive the interconnecting members 120 and 130. FIGS. 1 and 3 through 8 show the interconnecting members 120 and 130 respectively connected to the receiving members 62 and 64 so that the neck brace 20 is closed with the front section 42 aligned with the rear section 30. FIG. 2 illustrates the interconnecting members 120 and 130 removed from the receiving members 62 and 64 and the front section 42 rotated away from the rear section 30 by rotation of the movable attachment means 110. It will be appreciated that it is within the spirit and scope of the present invention to have at least one interconnecting means 120 or 130 and at least one receiving means 62 and 64 instead of the pair.

Optionally, the front section 74 of the body protector 70 may have a multiplicity of openings 140 which provide air openings to cool the body and also provide an ornamental feature. Similarly, the rear section 80 of the body protector 70 may have a multiplicity of openings 150 which provide air openings to cool the body and also provide an ornamental feature. It will be appreciated that it is within the spirit and scope of the present invention to have at least one opening in the front section 74 and at least one opening in the rear section 80.

In operation, the user unfastens the interconnecting members 120 and 130 from the receiving members 62 and 64 and rotates the front section 42 of the neck brace portion 20 away from the rear section 30 and lifts the entire combination neck brace incorporated into a body protector 10 over the user's head and fits the user's head through the opening 22. The assembly 10 is positioned so that the first arcuate connector section 76 rests on one shoulder of a wearer, the second arcuate connector section 78 rests on the opposite shoulder of the wearer, the front section 74 of the body protector 70 rests against the chest and front torso of the wearer, the rear section 80 of the body protector rests against the back and rear torso of the wearer, and the rear section 30 of the neck brace portion 20 rests around the back and a portion of the side of the neck of the wearer. The front section 42 of the neck brace portion 20 is the rotated to be aligned with the rear section 30 so that the neck brace portion 20 is closed and the interconnecting members 120 and 130 are respectively connected to their respective receiving members. The front portion of the wearer's neck rests within opening 24. The neck brace is interconnected to provide a tight secure support around the neck. The mating buckles 97 and 98 of interconnecting member 90 are closed and the mating buckles 107 and 108 of interconnecting member 100 are closed and the respective straps pulled so that the front section 74 and rear section 80 of the body protector 70 are respectively tightly fit against the front and back of the wearer's torso. The cushion member 36 and 48 provide further comfort and security around the wearer's neck.

Through use of the present invention neck brace incorporated into a body protector, the entire assembly provides substantially increased protection to a wearer over the prior simple neck brace or simple chest protector. By having a fully integrated unit, the entire neck area and body area of the wear is protected and the additional feature of the having the neck brace incorporated into and made a part of the body protector results in a much stronger protection device that can better absorb a shock force if the wearer is riding a motorcycle and becomes involved in an accident. The integrated combination of the neck brace and body protector form an entire integrated unit to be worn to protect the neck and body during an accident including preventing hyperextension of the neck in either the forward or rear directions to reduce the likelihood that the neck would be broken during an accident.

Defined in detail, the present invention is a protective apparatus to be worn around a neck and body of a wear, the protective apparatus comprising: (a) a combination neck brace incorporated into a body protector which is formed as an entire integrated unit to be worn to protect the neck and the body of a user; (b) the neck brace including two section each having an opening so that the neck brace surrounds the neck region of the body, the neck brace incorporated into and made a part of a protective shield which has a body portion that extends over a front portion and rear portion of a torso of the body of the wearer so that the neck brace portion is incorporated into the body protector portion to form a fully integrated unit; and (c) the neck brace formed into two sections with one section permanently affixed to the body portion and the one section movably affixed to the body portion so that the two sections can be separated to permit the apparatus to be fit over the neck and body of the wearer and thereafter moved to the closed position so that the neck brace surrounds the neck of the wearer.

Defined broadly, the present invention is a protective apparatus to be worn around a neck and body of a wear, the protective apparatus comprising: (a) a neck brace portion having a rear section which includes an arcuate planar section partially surrounding an interior opening and a front section which is movable relative to the rear section, the front section including an arcuate planar section which partially surrounds an interior opening, the rear section extending to a lateral neck brace body member, the front section extending to a front neck brace body portion; (b) a body protector having a front section and a rear section having upper portions which are interconnected by a respective first acuate connector section and a second arcuate connector section; and (c) the lateral neck brace body member permanently affixed to the rear section and first and second arcuate connector sections of the body protector and the front neck brace body portion movably connected to the front section of the body protector.

Defined more broadly, the present invention is a protective apparatus to be worn around a neck and body of a wear, the protective apparatus comprising: (a) a neck brace portion having a rear section partially surrounding an interior opening and a front section which is movable relative to the rear section, the front section partially surrounding an interior opening, the rear section extending to a lateral neck brace body member, the front section extending to a front neck brace body portion; (b) a body protector having a front section and a rear section having upper portions which are interconnected; and (c) the lateral neck brace body member permanently affixed to the rear section of the body protector and the front neck brace body portion movably connected to the front section of the body protector.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A protective apparatus to be worn around a neck and body of a wearer, the protective apparatus comprising:

a. a combination neck brace incorporated into a body protector which is formed as an entire integrated unit to be worn to protect the neck and the body of a user;

b. the neck brace including two section each having an opening so that the neck brace surrounds the neck region of the body, the neck brace incorporated into and made a part of a protective shield which has a body portion that extends over a front portion and rear portion of a torso of the body of the wearer so that the neck brace portion is incorporated into the body protector portion to form a fully integrated unit; and c. the neck brace formed into two sections with one section permanently affixed to the body portion and the one section movably affixed to the body portion so that the two sections can be separated to permit the apparatus to be fit over the neck and body of the wearer and thereafter moved to the closed position so that the neck brace surrounds the neck of the wearer.

2. The protective apparatus in accordance with claim 1 further comprising a cushioning means incorporated into the neck brace and positioned adjacent the openings in the two sections of the neck brace.

3. The protective apparatus in accordance with claim 1 wherein the neck brace and body portion are made of material from the group consisting of plastic, polyurethane and fiberglass.

4. The protective apparatus in accordance with claim 1 further comprising connecting straps to connect the portions of the body protector which extend over the front and rear of a torso.

5. The protective apparatus in accordance with claim 1 wherein the body protector further comprises a multiplicity of air openings.

6. A protective apparatus to be worn around a neck and body of a wearer, the protective apparatus comprising:

a. a neck brace portion having:

a rear section which includes an arcuate planar section partially surrounding a first portion of an interior opening;

a front section which is movable relative to the rear section, the front section including an arcuate planar section which partially surrounds a second portion of the interior opening, the first and second portions of the interior opening being interfitting;

a lateral neck brace body member, the rear section of the neck brace portion extending to the lateral neck brace body member; and a front neck brace body portion, the front section of the neck brace portion extending to the front neck brace body portion;

b. a body protector having a front section and a rear section having upper portions which are interconnected by a respective first arcuate connector section and a second arcuate connector section; and c. the lateral neck brace body member permanently affixed to the rear section and first and second arcuate connector sections of the body protector and the front neck brace body portion movably connected to the front section of the body protector.

7. The protective apparatus in accordance with claim 6 wherein the neck brace further comprises a cushioning member affixed to the rear section adjacent its opening and a cushioning member affixed to the front section adjacent its opening.

8. The protective apparatus in accordance with claim 6 further comprising a first lower interconnecting member connecting the front and rear sections of the body protector and a second lower interconnecting member connecting the front and rear sections of the body protector.

9. The protective apparatus in accordance with claim 6 wherein the front section of the body protector further comprises a multiplicity of openings.

10. The protective apparatus in accordance with claim 6 wherein the rear section of the body protector further comprises a multiplicity of openings.

11. The protective apparatus in accordance with claim 6 wherein the front neck brace body portion is rotatably connected to the front section of the body protector and further comprises locking means which are received within receiving means on the lateral neck brace body member.

12. The protective apparatus in accordance with claim 6 where the neck brace and the rear section, front section, and first and second arcuate connector sections of the body member are made of material from the group consisting of plastic, polyurethane and fiberglass.

13. A protective apparatus to be worn around a neck and body of a wearer, the protective apparatus comprising:

a. a neck brace portion having:

a rear section which includes an arcuate planar section partially surrounding a first portion of an interior opening;

a front section which is movable relative to the rear section, the front section including an arcuate planar section partially surrounding a second portion of the interior opening, the first and second portions of the interior opening being interfitting;

a lateral neck brace body member, the rear section of the neck brace portion extending to the lateral neck brace body member; and a front neck brace body portion, the front section of the neck brace portion extending to the front neck brace body portion;

b. a body protector having a front section and a rear section having upper portions which are interconnected; and c. the lateral neck brace body member permanently affixed to the rear section of the body protector and the front neck brace body portion movably connected to the front section of the body protector.

14. The protective apparatus in accordance with claim 13 wherein the neck brace further comprises a cushioning member affixed to the rear section adjacent its opening and a cushioning member affixed to the front section adjacent its opening.

15. The protective apparatus in accordance with claim 13 further comprising a first lower interconnecting member connecting the front and rear sections of the body protector and a second lower interconnecting member connecting the front and rear sections of the body protector.

16. The protective apparatus in accordance with claim 13 wherein the front section of the body protector further comprises a multiplicity of openings.

17. The protective apparatus in accordance with claim 13 wherein the rear section of the body protector further comprises a multiplicity of openings.

18. The protective apparatus in accordance with claim 13 wherein the front neck brace body portion is rotatably connected to the front section of the body protector and further comprises locking means which are received within receiving means on the lateral neck brace body member.

19. The protective apparatus in accordance with claim 13 where the neck brace and the rear section and front section of the body member are made of material from the group consisting of plastic, polyurethane and fiberglass.

* * * * *